US006350200B2

(12) United States Patent
Starrett et al.

(10) Patent No.: US 6,350,200 B2
(45) **Date of Patent: *Feb. 26, 2002**

(54) SAFETY TIPS FOR POLICE BATONS

(75) Inventors: Paul D. Starrett, Jaffrey; Terry Smith, Keene, both of NH (US)

(73) Assignee: Monadnock Lifetime Products, Inc., Fitzwilliam, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,937

(22) Filed: Dec. 10, 1998

(51) Int. Cl.[7] ..... F41B 15/02
(52) U.S. Cl. ..... 463/47.2; 463/47.7
(58) Field of Search ..... 463/47.2, 47.3, 463/47.4, 47.5, 47.6, 47.7; 135/75; D22/117

(56) References Cited

U.S. PATENT DOCUMENTS

| | | | | |
|---|---|---|---|---|
| 83,228 A | * | 10/1868 | Warne | |
| 1,334,188 A | * | 3/1920 | Swan | |
| 1,909,932 A | | 5/1933 | Digel | |
| 4,037,839 A | | 7/1977 | Nelson | 273/84 |
| 4,819,137 A | | 4/1989 | Hamilton | 362/102 |
| 4,957,057 A | * | 9/1990 | Marcucci | |
| 5,407,197 A | | 4/1995 | Parsons | 273/84 R |
| 5,839,967 A | * | 11/1998 | Moe | |
| 6,056,643 A | * | 5/2000 | Wilmoth | |

OTHER PUBLICATIONS

"Rubber Weapons", black Belt Magazine, p. 29, 1972.*

* cited by examiner

*Primary Examiner*—William M. Pierce
(74) *Attorney, Agent, or Firm*—Ernest V. Linek; Banner & Witcoff, Lt

(57) ABSTRACT

The present invention is directed to two forms of safety tips for friction lock, expandable batons; namely the Safety Tip™ and the Power Safety Tip™. Both safety tips of invention have a threaded end that is used to connect the tip to the small end of the baton. A step section with the same diameter as the small end diameter is advantageously used in the basic tip design to allow the shaft to be seated far enough into the handle to have full retention spring contact. The steel flange in the basic tip design also protects the softer peripheral tip cover material from being sheared off by the middle baton section when the baton is closed with a hard material in place on the steel section. In the power safety tip, the step section is the same diameter as the middle shaft of the baton, and this allows full contact with the retention spring. In both of the tip designs, the very end of the tip is rounded steel, the sides of which blend into the peripheral soft rubber-like material. The diameter of the rounded steel end is large enough so the baton may be struck on a hard surface, even at a slight angle, and the steel section will still come in contact with the hard surface, absorbing the energy and allowing the baton to collapse. If desired, the steel end can be coated with another material, but such coatings could wear off during repeated closures of the baton.

19 Claims, 1 Drawing Sheet

SAFETY TIPS FOR POLICE BATONS

BACKGROUND OF THE INVENTION

There have been a number of different types of steel friction lock police batons manufactured since about 1967. Typical friction locking batons include three telescoping shafts with an end cap at the handle end and a steel tip at the other end. Such batons are usually carried in the collapsed form (held by an internal retaining spring) and when flicked open (extended) the baton is locked open by matching tapers, which lock together by friction. A typical taper used is a standard Morse Taper similar to that used on tools such as drill press bits and lathe tail stocks. When the baton sections are locked together, the tapers must be separated with a sharp blow on a hard surface, such as forcing it briskly on a hard surface such as concrete or tile.

Because a sharp blow is required to close friction lock batons, the tip of the baton must also be hard, in order to fully transfer the sharp shock of the blow back to the tapers. This is why all baton tips have been hardened steel balls (or like shapes), which are threaded into the small telescoping shaft. Hardened steel balls may do more damage to the subject it is used on. There is more likelihood of cutting or puncturing an individual's skin. A tip on the baton made of a softer material, which would not cause the same amount of damage, would not allow the tapers to separate since the softer material would absorb the sharp blow.

Friction locking police batons with replaceable tips have been described in at least one prior art patent. See for example, U.S. Pat. No. 5,407,197, the disclosure of which is hereby incorporated herein by reference. In the '197 patent, an "o-ring" is sometimes used on the outer periphery of the tips (see, FIG. 4) to prevent rattling of the baton pieces when closed.

SUMMARY OF THE INVENTION

One embodiment of this invention is a "safety tip" for police batons. This tip has been designed for use on steel friction lock batons, replacing the commonly used solid steel tips, with a solid steel core material, either substantially, or completely surrounded by a softer, safer, compressible and/or flexible material. As used herein, the terms "substantially surrounded" mean that at least 50%, preferably at least 70%, more preferably at least 80%, and most preferably about 90% of the periphery of the baton tip is covered with the compressible material.

The combination design of the safety tip (steel core and outer soft material) still allows the tapers of such batons to be unlocked by transferring the energy of the sharp downward blow through the core of the tip, to the tapers.

Another embodiment of the present invention is another safety tip for police batons. This tip is longer than the basic safety tip, and it has been designated as the "power safety tip". The power safety tip has advantages over the basic safety tip as follows:

By their nature, steel friction lock batons are weighted more in the handle section of the baton than the small striking end. This is due to the construction of three steel tubes, the handle the largest and the small extended end the smallest. There are special requirements for closing the baton as stated above.

The use of a longer power safety tip moves the center of gravity of the baton toward the tip end by forming the tip with the same steel core/resilient outer cover design as described above, except that in the power safety tip, both the length and diameter of the tip are increased. This feature adds weight to the tip end, thereby moving the center of gravity toward the tip to give great impact on the striking end. Also it extends the baton several inches longer for greater reach.

By employing the same basic design as used for the basic safety tip, a baton employing the power safety tip will close properly and be safer than a standard friction lock baton against cutting etc. due to the rubber-like material used to cover the steel tip. The larger steel tip will give more weight, but must not be a greater diameter than the handle diameter so that it will fit into the standard baton holders.

DETAILED DESCRIPTION OF THE INVENTION

As described above, the present invention is directed to two forms of safety tips for friction lock, expandable batons; namely the Safety Tip™ and the Power Safety Tip™.

Figure 1:
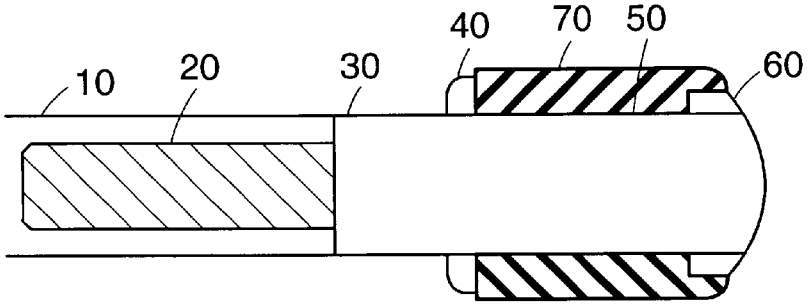
FIG. 1 illustrates the preferred basic "safety tip" of the present invention in cross-section. All dimensions shown are in inches or fractions thereof.

As illustrated in FIG. 1, the basic "safety tip" of the present invention has the following parts; a baton small end section (10), a threaded end (20), a steel shaft (30), which advantageously is the same diameter as the baton small end section (10), a larger steel flange (40) having a sufficient diameter to protect the rubber-like material from impact with the remainder of the baton. As illustrated, the tip utilizes a steel core section (50), which is smaller in diameter, and which is substantially completely surrounded in its periphery, by a compressible material (70). In the preferred embodiment, the forward end of the tip (60) is provided with a rounded, exposed steel end. This allows the closing impact of the baton to be directed from the hard surface through steel, directly to the remaining components of the baton. If a soft or compressible material is used at this point, some of the closing energy could be absorbed. The peripheral compressible material used is advantageously a rubber-like material, vinyl and neoprene are useful materials.

Figure 2:
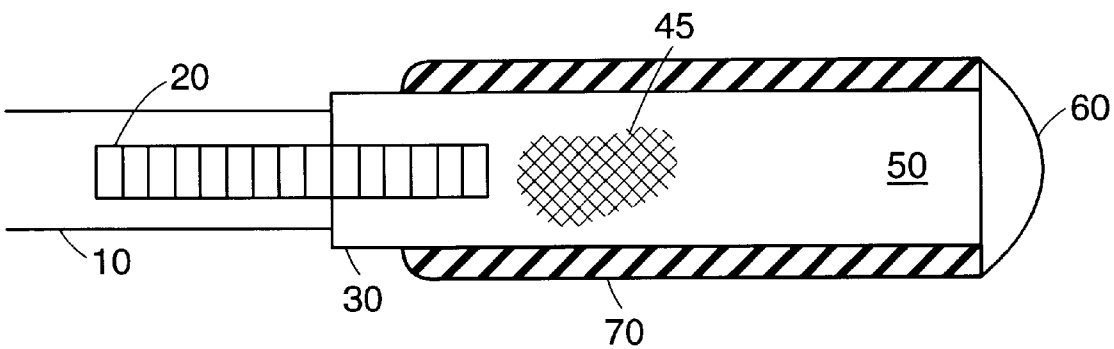
FIG. 2 illustrates the preferred "power safety tip" of the present invention in partial cross-section. All dimensions shown are in inches or fractions thereof.

As illustrated in FIG. 2, the "power safety tip" of the present invention has the following parts; a baton small end section (10), a threaded end (20), and a steel shaft (30), which advantageously is the same diameter as the baton middle section (thereby eliminating the need for the flange). As illustrated, the tip utilizes a steel core section (50), which may optionally include a raised knurl (45) on its periphery to assist in retaining the outer peripheral material (70). In the preferred embodiment, the forward end of the tip (60) is provided with a rounded, exposed steel end. This allows the closing impact of the baton to be directed from the hard surface through steel, directly to the remaining components of the baton. If a soft or compressible material is used at this point, some of the closing energy could be absorbed. The peripheral compressible material used is advantageously a rubber-like material, vinyl and neoprene are useful materials.

Both safety tips of the present invention have a threaded end that is used to connect the tip to the small end of the baton. A step section with the same diameter as the small end diameter is advantageously used in the basic safety tip design to allow the shaft to be seated far enough into the handle to have full retention spring contact. The steel flange also protects the softer peripheral tip cover material from being sheared off by the middle baton section when the baton is closed with a hard material in place on the steel section. This feature could likewise be employed with the power safety tip. However, the step section in the power safety tip design is the same diameter as the middle section of the baton, and this allows the tip to go into the handle sufficiently to engage the retaining spring.

In both of the preferred embodiments, the very end of the tip is rounded steel, the sides of which blend into the peripheral soft rubber-like material. The diameter of the rounded steel end is large enough so the baton may be struck on a hard surface, even at a slight angle, and the steel section will still come in contact with the hard surface, absorbing the energy and allowing the baton to collapse. If desired, the steel end can be coated with another material, but such coatings could wear off during repeated closures of the baton.

In both tip designs, sections 20, 30, 40, 50 and 60 are all made of steel and either one piece or fabricated together so that all of the above steel parts are rigid from the round tip (60) to the threaded end (20). This will allow the shock to be transferred to the baton tapers and at the same time have a striking area made from a softer rubber-like material.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. In a telescopic, multi-stage, tubular police baton comprising:

(a) a first elongated tubular handle section;

(b) a second elongated tubular middle section, said middle section adapted to telescopingly reciprocate within said handle section;

(c) a third elongated tubular inner section adapted to telescopingly reciprocate within said middle section; and (d) a metal tip attached to one end of the tubular inner section; the improvement comprising:

the metal tip further comprising an elongated metal body with a diameter no larger than that of third tubular section of the baton, said elongated metal body further including a compressible material surrounding at least about 25% of the periphery, with an exposed metal member at the end of the tip.

2. The improved metal tip of claim 1, wherein at least 50% of the outer surface of the tip is surrounded by the compressible material.

3. The improved metal tip of claim 1, wherein at least 70% of the outer surface of the tip is surrounded by the compressible material.

4. The improved metal tip of claim 1, wherein at least 80% of the outer surface of the tip is surrounded by the compressible material.

5. The improved metal tip of claim 1, wherein at least 90% of the outer surface of the tip is surrounded by the compressible material.

6. The improved metal tip of claim 1, wherein substantially all of the peripheral surface of the tip is surrounded by the compressible material.

7. The improved metal tip of claim 1, wherein the compressible material is a rubber substance.

8. The improved metal tip of claim 7, wherein the rubber substance is neoprene.

9. The improved metal tip of claim 7, wherein the rubber substance is vinyl.

10. In a telescopic, multi-stage, tubular police baton comprising:

(a) a first elongated metal tublar handle section;

(b) a second elongated metal tublar middle section, said middle section adapted to telescopingly reciprocate with said handle section;

(c) a third elongated metal tublar inner section adapted to telescopingly reciprocate within said middle section; and (d) a metal tip attached to one end of the tubular inner section; the improvement comprising:

the metal tip further comprising a cylindrical steel shaft, at least a portion of which is adapted to telescopingly reciprocate at least partially within said middle section of the police baton; said metal tip further comprising a compressible material surrounding at least a portion of the periphery of the tip.

11. The improved metal tip of claim 10, further comprising a threaded shaft whereby the tip is replaceable.

12. The improved metal tip of claim 11, wherein the compressible material is a rubber substance.

13. The improved metal tip of claim 12, wherein the rubber substance is neoprene.

14. The improved metal tip of claim 12, wherein the rubber substance is vinyl.

15. In a telescopic, multi-stage, tubular police baton comprising:

(a) a first elongated metal tubular handle section;

(b) a second elongated metal tubular middle section, said middle section adapted to telescopingly reciprocate within said handle section;

(c) a third elongated metal tubular inner section adapted to telescopingly reciprocate within said middle section; and (d) a metal tip attached to one end of the tubular inner section; the improvement comprising:

the metal tip further comprising a cylindrical steel shaft comprising a steel shaft with an outer diameter no longer than the third tubular section of the baton and a step section or flange member, with an outer diameter larger than the third tubular section of the baton, such that a portion of the metal tip is adapted to telescopingly reciprocate at least partially within said handle section of the police baton; said metal tip further comprising a compressible material surrounding at least a of the periphery of the tip.

16. The improved metal tip of claim 15, further comprising a threaded shaft whereby the tip is replaceable.

17. The improved metal tip of claim 15, wherein the compressible material is a rubber substance.

18. The improved metal tip of claim 17, wherein the rubber substance is neoprene.

19. The improved metal tip of claim 17, wherein the rubber substance is vinyl.

* * * * *